US012098637B2

(12) United States Patent
Feng et al.

(10) Patent No.: US 12,098,637 B2
(45) Date of Patent: Sep. 24, 2024

(54) I-PATTERNED FILLING METHOD FOR INITIAL STAGE OF COAL MINING BASED ON ROOF FRACTURE FEATURE CHARACTERITICS

(71) Applicant: Taiyuan University of Technology, Taiyuan (CN)

(72) Inventors: Guorui Feng, Taiyuan (CN); Wei Guo, Taiyuan (CN); Tingye Qi, Taiyuan (CN); Zhu Li, Taiyuan (CN); Jiaqing Cui, Taiyuan (CN); Yekai Cui, Taiyuan (CN); Jingkai Ma, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 18/595,263

(22) Filed: Mar. 4, 2024

(65) Prior Publication Data

US 2024/0209734 A1 Jun. 27, 2024

(51) Int. Cl.
*E21C 41/18* (2006.01)
*E21F 15/00* (2006.01)

(52) U.S. Cl.
CPC ..... *E21C 41/18* (2013.01); *E21C 2100/00* (2023.05); *E21F 15/00* (2013.01)

(58) Field of Classification Search
CPC ..... E21C 41/18; E21C 2100/00; E21F 15/00; E21F 17/18
See application file for complete search history.

(56) References Cited

U.S. PATENT DOCUMENTS 4,968,187 A * 11/1990 Burnett ..... E21F 15/00 405/269
9,494,037 B2 * 11/2016 Zhang ..... E21C 41/16
9,689,258 B2 * 6/2017 Ma ..... E21F 15/00
(Continued)

FOREIGN PATENT DOCUMENTS

AU 5103385 A 6/1986
AU 722846 B1 8/2000
(Continued)

OTHER PUBLICATIONS

Qiang Lyu et al., "Study on Mine Pressure Law and Adaptability of Support at Large Mining Height Face", Coal Technology, vol. 35, No. 3, Mar. 10, 2016, pp. 27-29.
(Continued)

*Primary Examiner* — Carib A Oquendo

(57) ABSTRACT

An I-patterned filling method for an initial stage of coal mining based on roof fracture characteristics is provided. A relationship between an overburden load borne by a main roof and an overhang size is determined based on principle of virtual work and a surgery theory when an overhang distance of the main roof reaches an initial weighting interval to enter a plastic limit state with an advance of a working face to obtain the initial weighting interval. An initial fracturing interval of an immediate roof is obtained in the same way. According to a subsidence law of the main roof in an inverted hip roof form, the filling is performed at a key position around an internal plastic hinge line through I-patterned three-strip filling. Size parameters of the I-pattered filling are designed to prevent the immediate roof and the main roof from being fractured.

1 Claim, 6 Drawing Sheets

(56) References Cited

U.S. PATENT DOCUMENTS

| | | | | |
|---|---|---|---|---|
| 10,787,906 | B2 * | 9/2020 | Guo | E21F 15/08 |
| 11,047,236 | B2 * | 6/2021 | Chen | E21C 41/18 |
| 11,834,949 | B2 * | 12/2023 | Guo | E21C 41/18 |
| 2022/0275726 | A1 * | 9/2022 | Wang | E21C 41/18 |
| 2024/0141783 | A1 * | 5/2024 | Zeng | E21B 47/11 |

FOREIGN PATENT DOCUMENTS

| | | | |
|---|---|---|---|
| AU | 2020100380 | A4 | 4/2020 |
| AU | 2020103698 | A4 | 2/2021 |
| CN | 101070759 | A | 11/2007 |
| CN | 101139928 | A | 3/2008 |
| CN | 102011588 | A | 4/2011 |
| CN | 102011611 | A | 4/2011 |
| CN | 102392644 | A | 3/2012 |
| CN | 103742147 | A | 4/2014 |
| CN | 107989613 | A | 5/2018 |
| CN | 108518222 | A | 9/2018 |
| CN | 108661643 | A | 10/2018 |
| CN | 108678769 | A | 10/2018 |
| CN | 113530544 | A | 10/2021 |
| CN | 113565510 | A | 10/2021 |
| CN | 113982694 | A | 1/2022 |
| CN | 115169752 | A | 10/2022 |
| CN | 115169752 | * | 12/2022 |
| CN | 116771348 | A | 9/2023 |

OTHER PUBLICATIONS

Guangqian Ouyang, "Surface Displacement Prediction and Evaluation of Filling Mining under Buildings", Shanxi Coal, vol. 31, No. 11, Nov. 15, 2011, pp. 40-41.

* cited by examiner

I-PATTERNED FILLING METHOD FOR INITIAL STAGE OF COAL MINING BASED ON ROOF FRACTURE FEATURE CHARACTERITICS

CROSS-REFERENCE TO RELATED APPLICATIONS

This application claims the benefit of priority from Chinese Patent Application No. 202311258590.3, filed on Sep. 27, 2023. The content of the aforementioned application, including any intervening amendments made thereto, is incorporated herein by reference in its entirety.

TECHNICAL FIELD

This application relates to backfill mining technologies, and more particularly to an I-patterned filling method for an initial stage of coal mining based on roof fracture characteristics.

BACKGROUND

Underground mining is the main method of coal mining. As the working face advances, the goaf roof will bend downward to be fractured, and the rock stratum on the roof will experience the large-area bending and subsidence, and so on, thereby causing damage to aquifers and surface water systems, and surface subsidence, and further seriously endangering surface buildings, roads, railways and water resource storage. In order to solve the above problems, the concept of "green mining" has been put forward. As an advanced green mining technology, the backfill mining can effectively deal with the coal resource waste problems such as overlying coal seams under water bodies, buildings or railways and residual coal pillars, as well as environmental problems such as surface subsidence and water and soil resource loss. The existing backfill mining methods and technologies used in coal mines mainly include working face solid filling, roadway solid filling, working face paste filling, overburden isolated grout injection and high-water material filling. However, some practical problems, such as high cost of filling materials, excessive size of required devices and systems and immature filling technology, have limited the development of backfill mining as well as its promotion and application in the underground coal mining.

SUMMARY

In order to solve the problems in the prior art, this application proposes the construction of filling bodies at key locations in a goaf based on roof fracture characteristics, so as to reduce the consumption of filling materials, lower the filling cost and effectively control the surface subsidence.

Specifically, this application provides an I-patterned filling method for an initial stage of coal mining based on roof fracture characteristics, comprising:

(1) determining a relationship between an overburden load borne by a main roof and an overhang size of the main roof based on principle of virtual work and a surgery theory when an overhang distance of the main roof reaches an initial weighting interval of the main roof to enter a plastic limit state with an advance of a working face, and calculating the initial weighting interval of the main roof through the following equation:

$$b = \frac{4h\sigma, \sqrt{3a^2q - 4\sqrt{2q\sigma_s}\,ah}}{3\sqrt{2}\,aq\sqrt{\sigma_s}, -8h\sigma_s\sqrt{q}};$$

wherein b is the initial weighting interval of the main roof, h is a thickness of the main roof, $\sigma_s$ is a tensile strength of the main roof, a is a width of the working face, and q is the overburden load borne by the main roof;

(2) determining a relationship between an overburden load borne by an immediate roof and an overhang size of the immediate roof based on the principle of virtual work and the surgery theory when an overhang distance of the immediate roof reaches an initial fracturing interval of the immediate roof to enter a plastic limit state with the advance of the working face, and calculating the initial fracturing interval of the immediate roof through the following equation:

$$L_0 = \frac{4h_0\sigma_{s0}\sqrt{3a^2q_0 - 4\sqrt{2q_0\sigma_{s0}}\,ah_0}}{3\sqrt{2}\,aq_0\sqrt{\sigma_{s0}} - 8h_0\sigma_{s0}\sqrt{q_0}};$$

wherein $L_0$ is the initial fracturing interval of the immediate roof, $h_0$ is a thickness of the immediate roof, $\sigma_{s0}$ is a tensile strength of the immediate roof, a is the width of the working face, and $q_0$ is the overburden load borne by the immediate roof; and (3) according to a subsidence law of the main roof in an inverted hip roof form, performing filling at a key position around an internal plastic hinge line through I-patterned three-strip filling;

wherein a first end strip is parallel to a haulage roadway, a second end strip is parallel to an air-return roadway, and a length of each of the first end strip and the second end strip is equal to the initial weighting interval b of the main roof; a width of the first end strip extending from a first end point of a central plastic hinge line towards the haulage roadway and a width of the second end strip extending from a second end point of the central plastic hinge line towards the air-return roadway are both 4, and $0<L_1<t$;

wherein t is a distance from the first end point of the central plastic hinge line to the haulage roadway or a distance from the second end point of the central plastic hinge line to the air-return roadway, and is calculated through the following equation:

$$t = \frac{\sqrt{2}\sqrt{q\sigma_s}\,h}{q};$$

a middle strip is perpendicular to the haulage roadway and the air-return roadway, and has the same length as the central plastic hinge line; the middle strip is located directly below the central plastic hinge line; the central plastic hinge line corresponds to a central position of the middle strip; and a width $L_2$ of the middle strip is determined by the initial weighting interval b of the main roof and the initial fracturing interval of the immediate roof, and satisfies $L_2>b-2L_0$, such that no fracture occurs in both the immediate roof and the main roof.

The present disclosure has the following beneficial effects.

This application uses a plate model to investigate the subsidence law of the roof, which can eliminate the limitation that a beam model cannot clearly explain the deformation of an overburden spatial structure. In addition, the plastic mechanics theory is introduced to quantitatively analyze the size of the fractured rock of the roof, which has practical and efficient calculation process, and is of great significance for fixed-point support in a goaf area. On this basis, the I-patterned filling method around the internal plastic hinge line key position is proposed, which can effectively support the key position of a fractured roof at a low filling dosage, alleviate the subsidence of the roof, and maintain the safety of a working face space, thereby achieving reduction of the filling cost, control of the ground surface subsidence and green mining.

BRIEF DESCRIPTION OF THE DRAWINGS

The accompanying drawings constituting a part of this application are intended to provide a further understanding of the present disclosure. The embodiments of the present disclosure and descriptions thereof are intended to explain the present disclosure, and are not intended to limit the scope of the present disclosure.

DETAILED DESCRIPTION OF EMBODIMENTS

The present disclosure will be described in detail below with reference to the accompanying drawings in the embodiments of the present disclosure. The present disclosure provides an I-patterned filling method for an initial stage of coal mining based on roof fracture characteristics, which is particularly suitable for a first mining face, and includes the following steps.

Step (1) A relationship between an overburden load borne q by a main roof and an overhang size of the main roof (including width and length, the width refers to a mining width of a working face, and the length is an initial weighting interval b of the main roof) based on principle of virtual work and a surgery theory when an overhang distance of the main roof reaches an initial weighting interval b of the main roof to enter a plastic limit state with an advance of the working face is determined, and the initial weighting interval b of the main roof is calculated.

Figure 1:
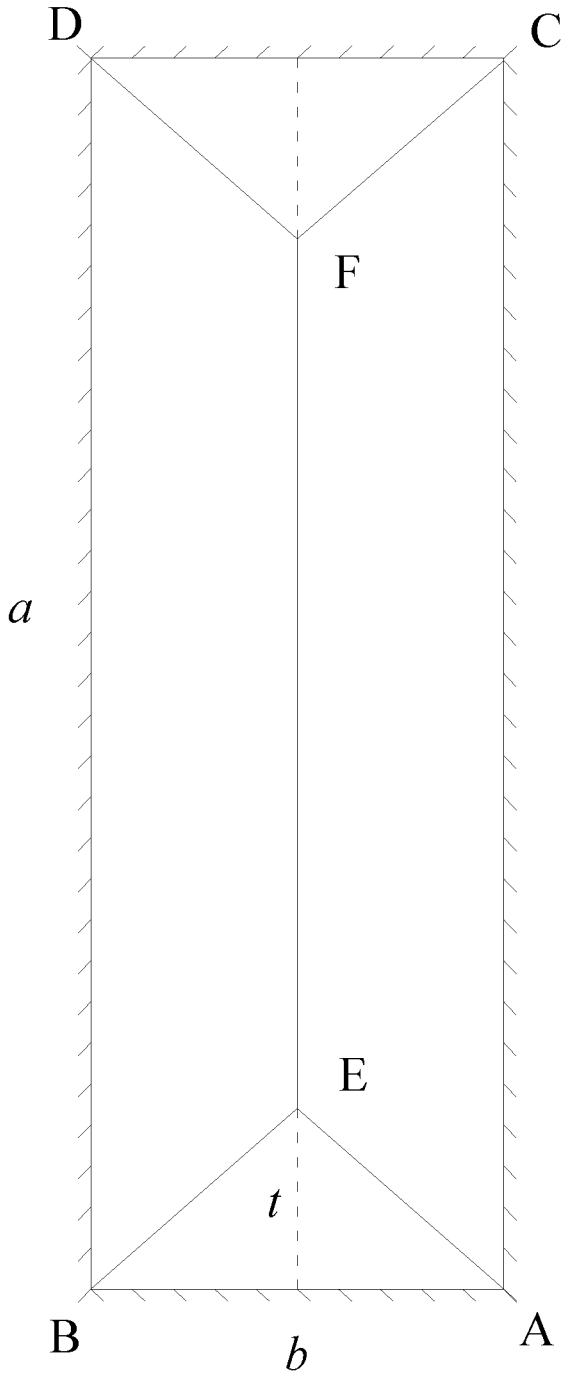
FIG. 1 is a top view of a main roof in a plastic limit state in accordance with an embodiment of the present disclosure.
Figure 2:
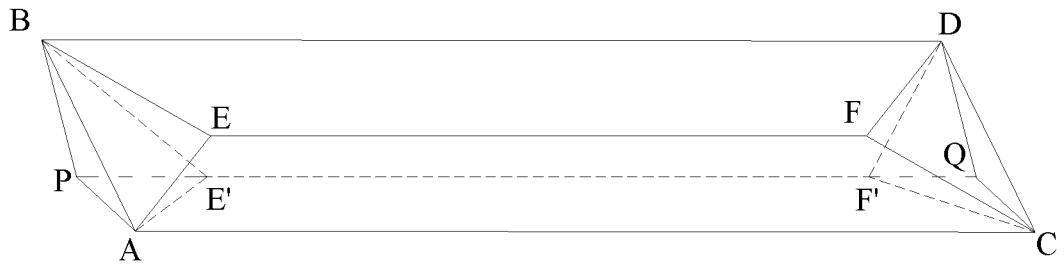
FIG. 2 schematically shows calculation of a volume of an inverted hip roof based on a surgery theory in accordance with an embodiment of the present disclosure.
Figure 3:
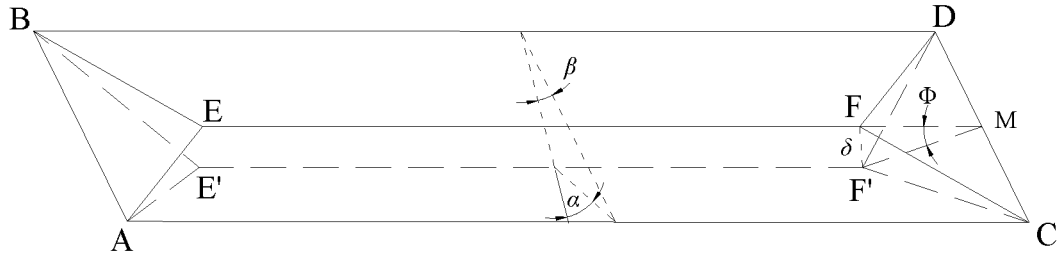
FIG. 3 is a three-dimensional view of the main roof in the plastic limit state in accordance with an embodiment of the present disclosure.

Specifically, FIG. 1 is a top view of the main roof in the plastic limit state before collapsing for the first time. As shown in FIG. 1, BA corresponds to a boundary of the main roof located at a haulage roadway of the working face, and DC corresponds to a boundary of the main roof located at an air-return roadway of the working face. BD corresponds to a boundary of the main roof located at an open-off cut, and CA corresponds to an advancing position of the main roof located at the working face. When the main roof BDCA reaches the plastic limit state as the working face advances, plastic hinge lines are generated. The plastic limit state is a critical state of the main roof between fracture and non-fracture. According to principle of virtual work, the main roof has a tendency to fracture, resulting in a virtual displacement. Fractured blocks are hinged to each other and sink as a whole. The plastic hinge lines are maximum bending moment positions of the main roof, and are also hinge lines of each of the fractured blocks, which are in a double Y shape, such as AE, BE, CF, DF and EF in FIG. 1. As shown in FIG. 1, AE, BE, DF, CF and EF are internal plastic hinge lines, EF is a central plastic hinge line, and BD, BA, AC and DC are boundary plastic hinge lines. A width of the working face is determined as a, which is also a length of the open-off cut. The initial weighting interval of the main roof is b. A position parameter of a central plastic hinge line EF is t, which represents a distance from an end point of the central plastic hinge line EF to the haulage roadway or the air-return roadway. As shown in FIGS. 2-3, the main roof is not only in the plastic limit state but also in an initial weighting fracture state when an advancing distance of the working face is b, such that after the main roof is fractured, five hinge lines AE', BE', CF', DF', and E'F' can be formed, where E'F' is a central hinge line.

According to principle of virtual work, an external virtual work W is calculated by the following equation:

$$W=q\iint w(x,y)dxdy.$$

In the above equation, q is a load borne by a destruction mechanism, i.e., the overburden load borne by the main roof, $\iint w(x,y)dxdy$ is a volume of a virtual displacement of the destruction mechanism, w(x,y) is the virtual displacement, and x and y are coordinate axes corresponding to a rectangular coordinate system set when calculating the volume of the virtual displacement of the destruction mechanism.

As shown in FIG. 2, the volume of the virtual displacement of the destruction mechanism is calculated using a geometric surgery theory. As the working face advances, the main roof reaches the plastic limit state. Based on the principle of virtual work, the main roof can fracture along the internal plastic hinge lines to generate a virtual displacement. After the virtual displacement is generated, the main roof is equivalent to being concave, thereby forming an inverted hip roof BDCA-E'F' (after the main roof is fractured by an initial weight, the virtual displacement becomes a real displacement, which also results in the inverted hip roof BDCA-E'F'). The inverted hip roof BDCA-E'F' is composed of an initial state of the main roof and a state after the virtual displacement is generated. The initial state is BDCA-EF, which is allowed to concave downward to form the central hinge line E'F' of a fractured block after the virtual displacement is generated. The central plastic hinge line EF is an initial state of the central hinge line E'F'. A volume of the inverted hip roof BDCA-E'F' is the volume of the virtual displacement of the destruction mechanism. The volume of the inverted hip roof BDCA-E'F' can be obtained by subtracting volumes of tetrahedrons PAB-E' and QCD-F' from a volume of a triangular prism PAB-QCD. Endpoints P and Q of the triangular prism PAB-QCD are collinear with E'F'. The triangular prism PAB-QCD is made to assist in obtaining the volume of the inverted hip roof BDCA-E'F'. The volume of the inverted hip roof BDCA-E'F' is calculated as $$V = \frac{ab\delta}{2} - \frac{bt\delta}{3},$$

where δ represents a maximum deflection, i.e., a distance between the central plastic hinge line EF and the central hinge line E'F', which is also a height of the inverted hip roof BDCA-E'F'. Furthermore, a virtual work of an external force is calculated as $$W = Vq = \left(\frac{ab\delta}{2} - \frac{bt\delta}{3}\right)q.$$

A total virtual dissipated energy T of internal forces is virtual works of internal forces done by ultimate bending moments at the plastic hinge lines on relative rotation angles, which is calculated by the following equation:

$$T = \sum_{i=1}^{k} \int_{l} M_p \varphi ds.$$

In the above equation, k is the number of the plastic hinge lines, l is a length of each of the plastic hinge lines, φ is the relative rotation angle of the fractured block, which refers to an angle between an initial state of the fractured block and a sinking state after the fractured block is fractured, and $M_p$ is an ultimate bending moment per unit length of each of the plastic hinge lines.

As shown in FIG. 3, relative angles of the internal plastic hinge line AE, the internal plastic hinge line BE, the internal plastic hinge line CF and the internal plastic hinge line DF are all θ. A size of θ is equal to an angle between a surface ABE' and a surface BDF'E' (θ is not shown in FIG. 3). A normal vector of the surface ABE' and a normal vector of the surface BDF'E' are calculated, respectively. According to a relationship between an angle between normal vectors and a dihedral angle, and an infinitesimal nature of the virtual displacement, it can be obtained that $$\theta = \tan\theta = \frac{\delta\sqrt{4\delta^2 + b^2 + 4t^2}}{bt}.$$

Lengths of the internal plastic hinge line AE, the internal plastic hinge line BE, the internal plastic hinge line CF and the internal plastic hinge line DF are all $$\sqrt{\frac{b^2}{t} + t^2}.$$

Furthermore, a virtual work $T_1$ of an internal force done by the internal plastic hinge line AE, a virtual work $T_2$ of an internal force done by the internal plastic hinge line BE, a virtual work $T_3$ of an internal force done by the internal plastic hinge line CF and a virtual work $T_4$ of an internal force done by the internal plastic hinge line DF are calculated as $$T_1 = T_2 = T_3 = T_4 = \delta M_p \sqrt{\frac{4\delta^2 + b^2}{4t^2} + \frac{4(t^2 + \delta^2)}{b^2} + 2}.$$

Figure 4:
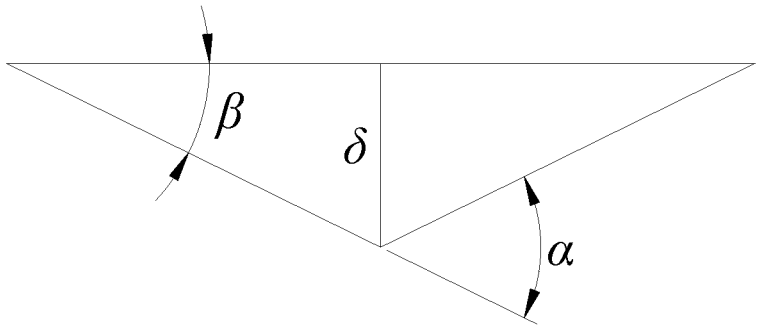
FIG. 4 schematically illustrates a relative rotation angle $\alpha$ of a central plastic hinge line EF, a relative rotation angle $\beta$ of a boundary plastic hinge line AC and a relative rotation angle $\beta$ of a boundary plastic hinge line BD in accordance with an embodiment of the present disclosure.

As shown in FIGS. 3-4, relative rotation angles of a boundary plastic hinge line AC and a boundary plastic hinge line BD are both β. A size of β is equal to an angle between a surface ACDB and a surface ACF'E'. According to the infinitesimal nature of the virtual displacement, it can be obtained that $$\beta = \tan\beta = \frac{2\delta}{b}.$$

Furthermore, a virtual work $T_5$ of an internal force done by the boundary plastic hinge line AC and a virtual work $T_6$ of an internal force done by the boundary plastic hinge line BD are calculated as $$T_5 = T_6 = \frac{2a\delta M_p}{b}.$$

As shown in FIGS. 3-4, a relative rotation angle of the central plastic hinge line EF is α. A size of α is equal to an angle between the surface ACF'E' and the surface BDF'E'. According to the infinitesimal nature of the virtual displacement, it can be obtained that $$\alpha = 2\beta = 2\tan\beta = \frac{4\delta}{b}.$$

Furthermore, a virtual work $T_7$ of an internal force done by the central plastic hinge line EF is calculated as $$T_7 = \frac{4\delta(a - 2t)M_p}{b}.$$

Figure 5:
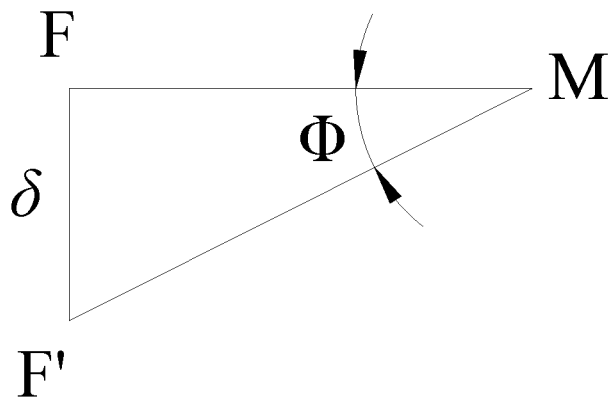
FIG. 5 schematically illustrates a relative rotation angle $\Phi$ of a boundary plastic hinge line BA and a relative rotation angle $\Phi$ of a boundary plastic hinge line DC in accordance with an embodiment of the present disclosure.

As shown in FIGS. 3 and 5, relative rotation angles of a boundary plastic hinge line BA and a boundary plastic hinge line DC are both Φ. A size of Φ is equal to an angle between a surface ABCD and a surface CDF'. M is a midpoint of the boundary plastic hinge line DC, which is an intersection point of an extension line of the central plastic hinge line EF and the boundary plastic hinge line DC. According to the infinitesimal nature of the virtual displacement, it can be obtained that $$\Phi = \tan\Phi = \frac{\delta}{t}.$$

Furthermore, a virtual work $T_8$ of an internal force done by the boundary plastic hinge line BA and a virtual work $T_9$ of an internal force done by the boundary plastic hinge line DC are calculated as $$T_8 = T_9 = \frac{\delta b M_p}{t}.$$

The total virtual dissipated energy of internal forces is calculated by the following equation:

$$T = \sum_{i=1}^{k} \int_i M_p \varphi ds = \sum_{i=1}^{9} T_i = 4\delta M_p \left[ \sqrt{\frac{4\delta^2 + b^2}{4t^2} + \frac{4(t^2 + \delta^2)}{b^2} + 2} + \frac{2(a-t)}{b} + \frac{b}{2t} \right].$$

According to the principle of virtual work, it is allowed that W=T, and $$q = \frac{24 M_p \left[ \sqrt{\frac{4\delta^2 + b^2}{4t^2} + \frac{4(t^2 + \delta^2)}{b^2} + 2} + \frac{2(a-t)}{b} + \frac{b}{2t} \right]}{3ab - 2bt}.$$

Due to the infinitesimal nature of the virtual displacement, a central deflection of the main roof is infinitely close to zero, which can result in $$\lim_{\delta \to 0} q = \frac{24(b^2 + 2at)M_p}{bt(3ab - 2bt)}.$$

The ultimate bending moment per unit length of each of the plastic hinge lines of the main roof with a thickness of h is $$M_p = \frac{\sigma_s h^2}{6}$$

(where $\sigma_s$ is a tensile strength of the main roof), the equation $$\lim_{\delta \to 0} q = \frac{24(b^2 + 2at)M_p}{bt(3ab - 2bt)}$$

is substituted to obtain $$\lim_{\delta \to 0} q = \frac{4(b^2 + 2at)\sigma_s h^2}{bt(3ab - 2bt)}.$$

Furthermore, the initial weighting interval of the main roof is calculated by the following equation:

$$b = \frac{2\sqrt{2}\, h \sqrt{(3aqt - 4\sigma_s h^2 - 2qt^2)at\sigma_s}}{3aqt - 4\sigma_s h^2 - 2qt^2}.$$

The position parameter t of the central plastic hinge line is obtained from a minimum value of b, i.e., $$\frac{db}{dt} = 0 \Rightarrow t = \frac{\sqrt{2}\sqrt{q\sigma_s}\, h}{q},$$

which is substituted into the equation for calculating the initial weighting interval of the main roof to obtain $$b = \frac{4h\sigma_s \sqrt{3a^2 q - 4\sqrt{2q\sigma_s}\, ah}}{3\sqrt{2}\, aq\sqrt{\sigma_s} - 8h\sigma_s\sqrt{q}}.$$

Step (2) Referring to the calculation method of the initial weighting interval of the main roof, a relationship between an overburden load borne by an immediate roof and an overhang size of the immediate roof (including width and length, the width refers to the mining width of the working face, and the length is an initial fracturing interval $L_0$ of the immediate roof) based on the principle of virtual work and the surgery theory when the overhang distance of the immediate roof reaches an initial fracturing interval $L_0$ of the immediate roof to enter a plastic limit state with the advance of the working face is determined, and the initial fracturing interval $L_0$ of the immediate roof is calculated by the following equation:

$$L_0 = \frac{4h_0\sigma_{s0} \sqrt{3a^2 q_0 - 4\sqrt{2q_0\sigma_{s0}}\, ah_0}}{3\sqrt{2}\, aq_0\sqrt{\sigma_{s0}} - 8h_0\sigma_{s0}\sqrt{q_0}}.$$

In the above equation, $L_0$ is the initial fracturing interval of the immediate roof, $h_0$ is a thickness of the immediate roof, $\sigma_{s0}$ is a tensile strength of the immediate roof, a is the width of the working face, and $q_0$ is the overburden load borne by the immediate roof.

Figure 6:
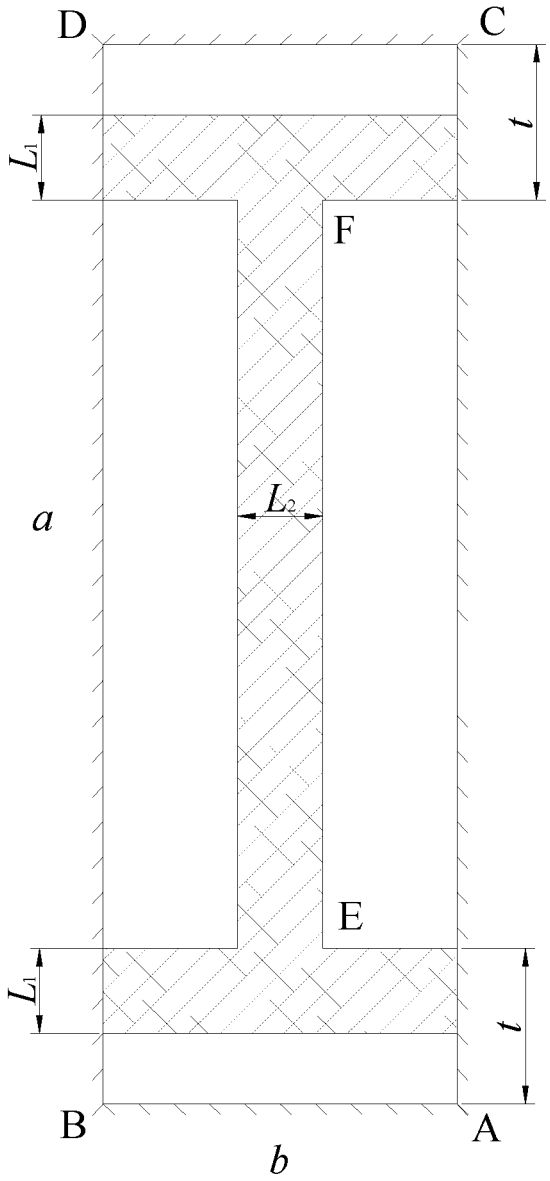
FIG. 6 is a schematic diagram showing the filling at a key position using an I-patterned filling strip in accordance with an embodiment of the present disclosure.

Step (3) According to a subsidence law of the main roof in an inverted hip roof form, a solution for filling a key position around the internal plastic hinge lines is proposed in the present disclosure. As shown in FIG. 6, an I-patterned three-strip filling form is adopted. A first end strip is parallel to the haulage roadway, and a second end strip is parallel to the air-return roadway. The first end strip and the second end strip have the same length as the initial weighting interval b of the main roof. A width of the first end strip extending from a first end point of a central plastic hinge line towards the haulage roadway and a width of the first end strip extending from a first end point of a central plastic hinge line towards the haulage roadway are both $L_1$, and $0<L_1<t$, where t is a distance from the first end point of the central plastic hinge line to the haulage roadway or a distance from the second end point of the central plastic hinge line to the air-return roadway, and is calculated as $$t = \frac{\sqrt{2}\sqrt{q\sigma_s}\, h}{q}.$$

A middle strip is perpendicular to the haulage roadway and air-return roadway, and has the same length as the central plastic hinge line EF. The middle strip is located directly below the central plastic hinge line EF. The central plastic hinge line EF corresponds to a central position of the middle strip. A width $L_2$ of the middle strip is determined by the initial weighting interval b of the main roof and the initial fracturing interval of the immediate roof, and satisfies $L_2>b-2L_0$, such that no fracture occurs in both the immediate roof and the main roof.

What is claimed is:

1. An I-patterned filling method for an initial stage of coal mining based on roof fracture characteristics, comprising:

(1) determining a relationship between an overburden load borne by a main roof and an overhang size of the main roof based on principle of virtual work and a surgery theory when an overhang distance of the main roof reaches an initial weighting interval of the main roof to enter a plastic limit state with an advance of a working face, and calculating the initial weighting interval of the main roof through the following equation:

$$b = \frac{4h\sigma_s\sqrt{3a^2q - 4\sqrt{2q\sigma_s}\,ah}}{3\sqrt{2}\,aq\sqrt{\sigma_s} - 8h\sigma_s\sqrt{q}};$$

wherein b is the initial weighting interval of the main roof, h is a thickness of the main roof, $\sigma_s$ is a tensile strength of the main roof, a is a width of the working face, and q is the overburden load borne by the main roof;

(2) determining a relationship between an overburden load borne by an immediate roof and an overhang size of the immediate roof based on the principle of virtual work and the surgery theory when an overhang distance of the immediate roof reaches an initial fracturing interval of the immediate roof to enter a plastic limit state with the advance of the working face, and calculating the initial fracturing interval of the immediate roof through the following equation:

$$L_0 = \frac{4h_0\sigma_{s0}\sqrt{3a^2q_0 - 4\sqrt{2q_0\sigma_{s0}}\,ah_0}}{3\sqrt{2}\,aq_0\sqrt{\sigma_{s0}} - 8h_0\sigma_{s0}\sqrt{q_0}};$$

wherein $L_0$ is the initial fracturing interval of the immediate roof, $h_0$ is a thickness of the immediate roof, $\sigma_{s0}$ is a tensile strength of the immediate roof, a is the width of the working face, and $q_0$ is the overburden load borne by the immediate roof; and (3) according to a subsidence law of the main roof in an inverted hip roof form, performing filling at a key position around an internal plastic hinge line through I-patterned three-strip filling;

wherein a first end strip is parallel to a haulage roadway, a second end strip is parallel to an air-return roadway, and a length of each of the first end strip and the second end strip is equal to the initial weighting interval b of the main roof; a width of the first end strip extending from a first end point of a central plastic hinge line towards the haulage roadway and a width of the second end strip extending from a second end point of the central plastic hinge line towards the air-return roadway are both $L_1$, and $0<L_1<t$;

wherein t is a distance from the first end point of the central plastic hinge line to the haulage roadway or a distance from the second end point of the central plastic hinge line to the air-return roadway, and is calculated through the following equation:

$$t = \frac{\sqrt{2}\sqrt{q\sigma_s}\,h}{q};$$

a middle strip is perpendicular to the haulage roadway and the air-return roadway, and has the same length as the central plastic hinge line; the middle strip is located directly below the central plastic hinge line; the central plastic hinge line corresponds to a central position of the middle strip; and a width $L_2$ of the middle strip is determined by the initial weighting interval b of the main roof and the initial fracturing interval of the immediate roof, and satisfies $L_2>b-2L_0$, such that no fracture occurs in both the immediate roof and the main roof.

* * * * *